US005749313A

United States Patent [19]

Shackelford, Jr.

[11] Patent Number: 5,749,313

[45] Date of Patent: May 12, 1998

[54] WATERCRAFT LIFT

[76] Inventor: Francis H. Shackelford, Jr., Hwy. 123 South, Hookerton, N.C. 28538

[21] Appl. No.: 788,425

[22] Filed: Jan. 28, 1997

Related U.S. Application Data

[60] Provisional application No. 60/011,217 Feb. 6, 1996.

[51] Int. Cl.[6] ..... B63C 1/02

[52] U.S. Cl. ..... 114/48; 405/3

[58] Field of Search ..... 114/44, 45, 48, 114/258, 259, 365, 368, 369, 373; 405/2, 3

[56] References Cited

U.S. PATENT DOCUMENTS

| | | | |
|---|---|---|---|
| 1,695,674 | 12/1928 | Wilson . | |
| 2,808,016 | 10/1957 | Jarnot . | |
| 2,979,014 | 4/1961 | Yordi . | |
| 2,990,803 | 7/1961 | Henderson . | |
| 3,060,885 | 10/1962 | Nolf . | |
| 3,177,839 | 4/1965 | Nolf . | |
| 3,830,452 | 8/1974 | Seay . | |
| 4,983,067 | 1/1991 | Montgomery | 405/3 |
| 5,014,638 | 5/1991 | Ilves et al. . | |
| 5,143,182 | 9/1992 | Basta | 114/44 |
| 5,245,940 | 9/1993 | Rockwood | 405/3 |
| 5,301,628 | 4/1994 | Daskalides . | |
| 5,590,978 | 1/1997 | Urbank | 114/48 |

FOREIGN PATENT DOCUMENTS 588394 5/1947 United Kingdom .

*Primary Examiner*—Ed L. Swinehart
*Attorney, Agent, or Firm*—Rosenthal & Putterman

[57] ABSTRACT

A watercraft lift of the type which is connected to a mooring location comprises a mounting and a guide. The guide mounts an elongate reciprocating member which is raised and lowered by means of a winch. At the lower end of the reciprocating member is a support bracket which is adapted to receive the watercraft. In an alternate embodiment of the invention the mounting and the guide means are hingedly connected so that the lift pivots approximately one hundred and eighty degrees so that the watercraft may be moved into and out of the water and also may be placed on the support bracket when not in use.

8 Claims, 7 Drawing Sheets

WATERCRAFT LIFT

This application claims the benefit of U.S. Provisional Application No.: Application Ser. No.: 60/011,217 filing date Feb. 6, 1966.

FIELD OF THE INVENTION

This invention relates generally to the field of watercraft lifts and more particularly to personal watercraft lifts wherein the lift apparatus is located entirely out of the water in order to slow corrosion and prevent the growth of aquatic plants and animals thereon.

BACKGROUND OF THE INVENTION

It is well known that watercraft should be stored out of the water when not in use. This is due to the fact that additional wear and tear on the watercraft is produced when the watercraft is allowed to remain in the water. For example, the watercraft may be moored to a dock. During inclement weather, the watercraft may rub or bump against the dock, resulting in damage to the watercraft. In addition, when the watercraft is stored in the water for prolonged periods of time, various aquatic plant and animal life begin to grow on the submerged hull which results in increased maintenance costs and decreased performance.

It is also well known that extant personal watercraft lifts of the type connected to a mooring of a pier must by design be mounted partially beneath the water's surface to operate as intended, and that the prolonged submersion of the apparatus results in corrosion and the buildup of aquatic plant and animal life on the lift itself, resulting in decreased performance capacity and a continual need for maintenance.

It is, therefore an object of the present invention to provided a new and improved personal watercraft lift.

It is another object of the present invention to provide a watercraft lift which mounts entirely above the water level, and which reaches into the water only when in use It is a further object of the present invention to provide an improved watercraft lift that is inexpensive, easy to install and reliable.

It is still another object of the present invention to provide an improved watercraft lift that may be used in conjunction with standard equipment found on watercraft.

It is a further object of the present invention to provide an improved watercraft lift that is substantially maintenance free.

SUMMARY OF THE INVENTION

The foregoing objects are accomplished by providing a watercraft lift of the type connected to a mooring location such as a dock, pier, or piling in which the lift is mounted totally above the water's surface and in which no part of the lift extends permanently beneath the water's surface, and in which temporarily submersible elements can lift a watercraft into a body of water and out of the body of water for storage.

The lift comprises a mounting means for connecting the lift to the mooring location above the water level. A guide means or guide is provided and is connected to the mounting means above the water level. A plurality of roller means or rollers are positioned for rotation within the guide means and a winch means is operably associated with the guide means. An elongate member having an upper end and a lower end is mounted for reciprocating movement within the guide means and is guided by the roller means. A support bracket means is connected to the elongate member proximate the lower end thereof and supports the watercraft resting thereon such that the winch means is operative to raise and lower the support bracket means, whereby the watercraft resting thereon may be raised out of and lowered into the water as desired.

DETAILED DESCRIPTION OF THE ILLUSTRATED EMBODIMENTS

While the present invention will be described more fully hereinafter with reference to the accompanying drawings, in which particular embodiments are shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Figure 1:
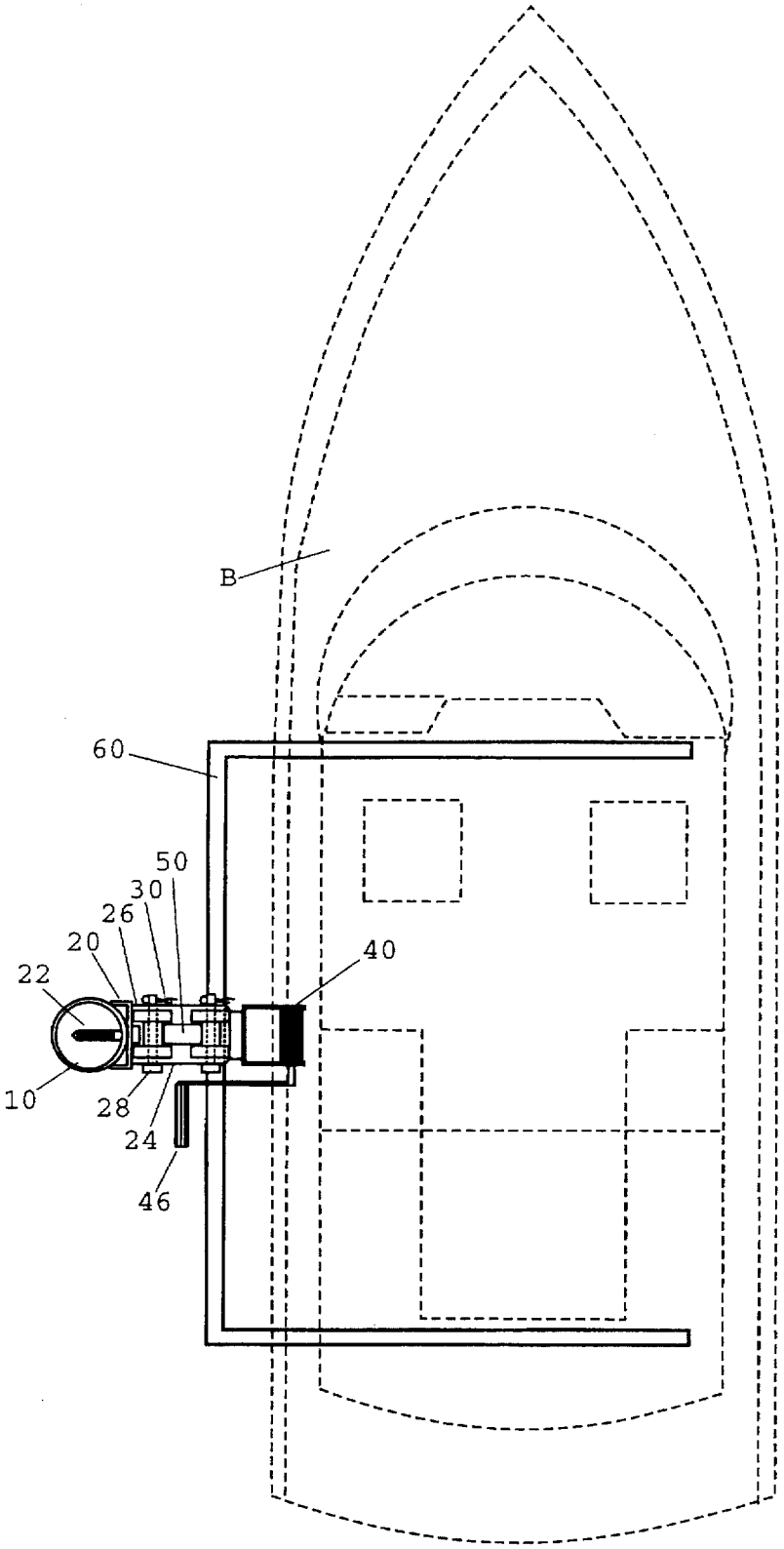
FIG. 1 is a plan view of the watercraft lift according to the present invention connected to a piling and showing a watercraft positioned thereon.
Figure 2:
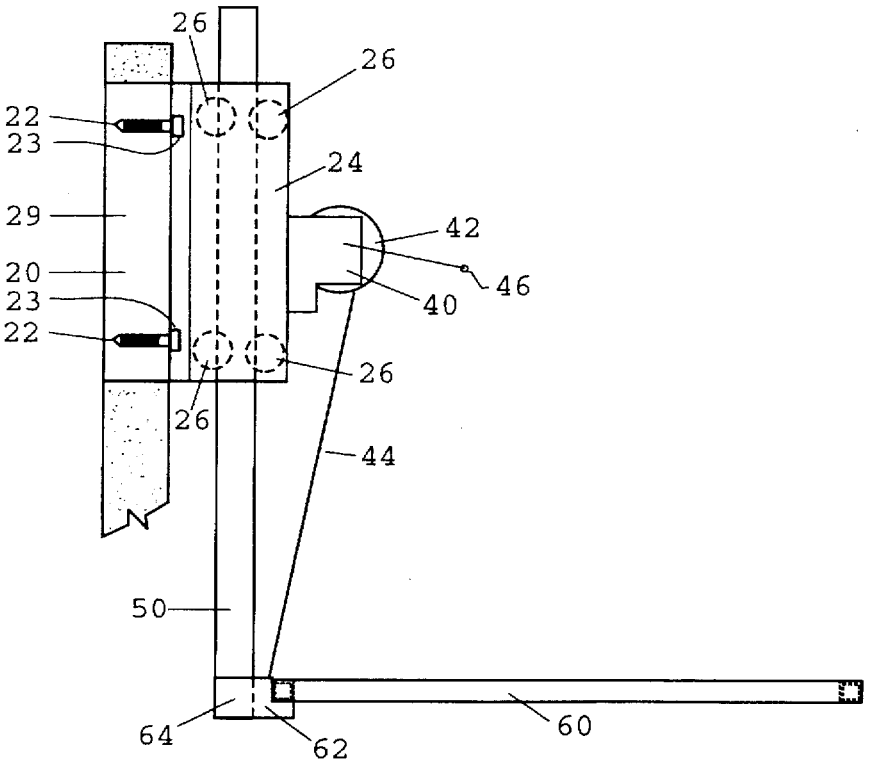
FIG. 2 is a side view of the watercraft lift according to the present invention.
Figure 3:
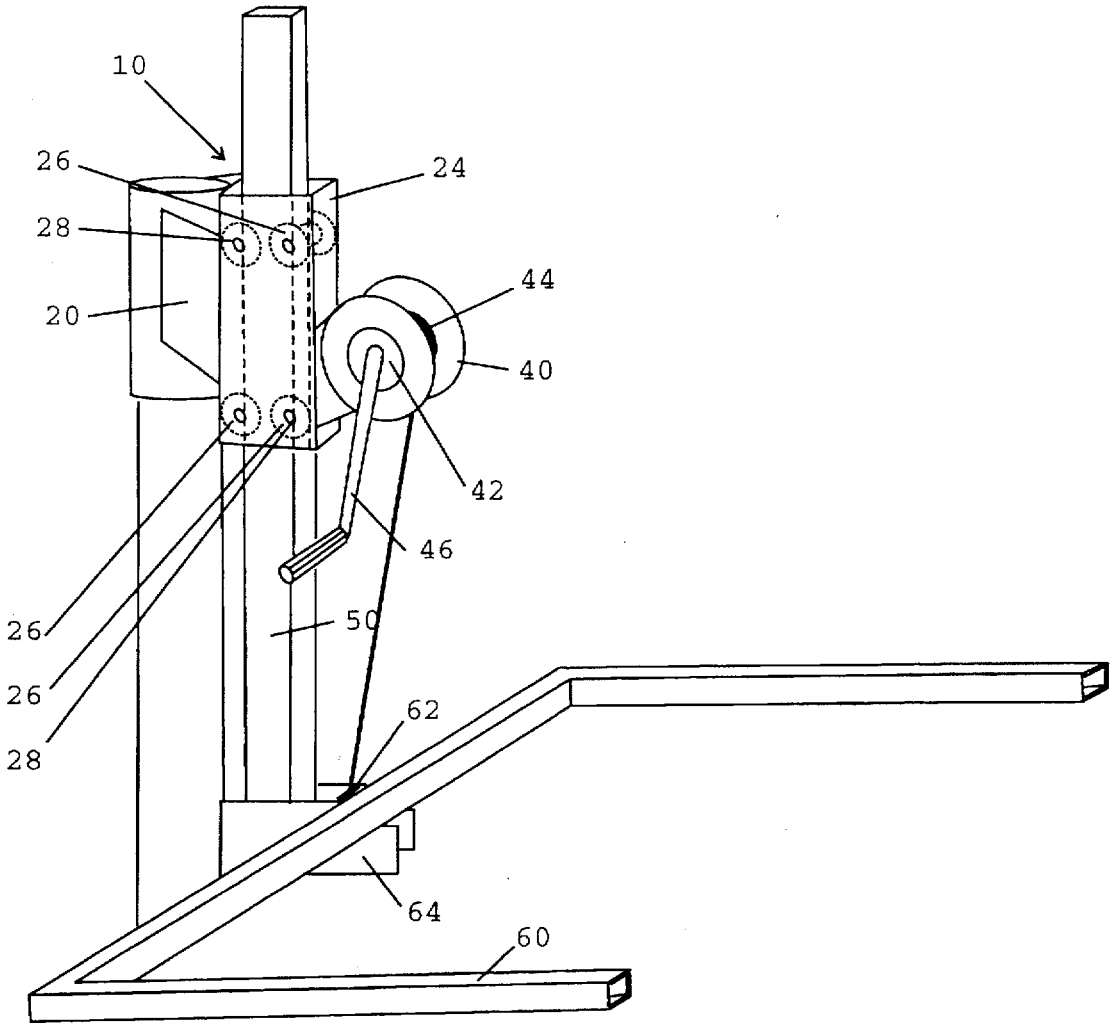
FIG. 3 is a perspective view of the watercraft lift according to the present invention.
Figure 4:
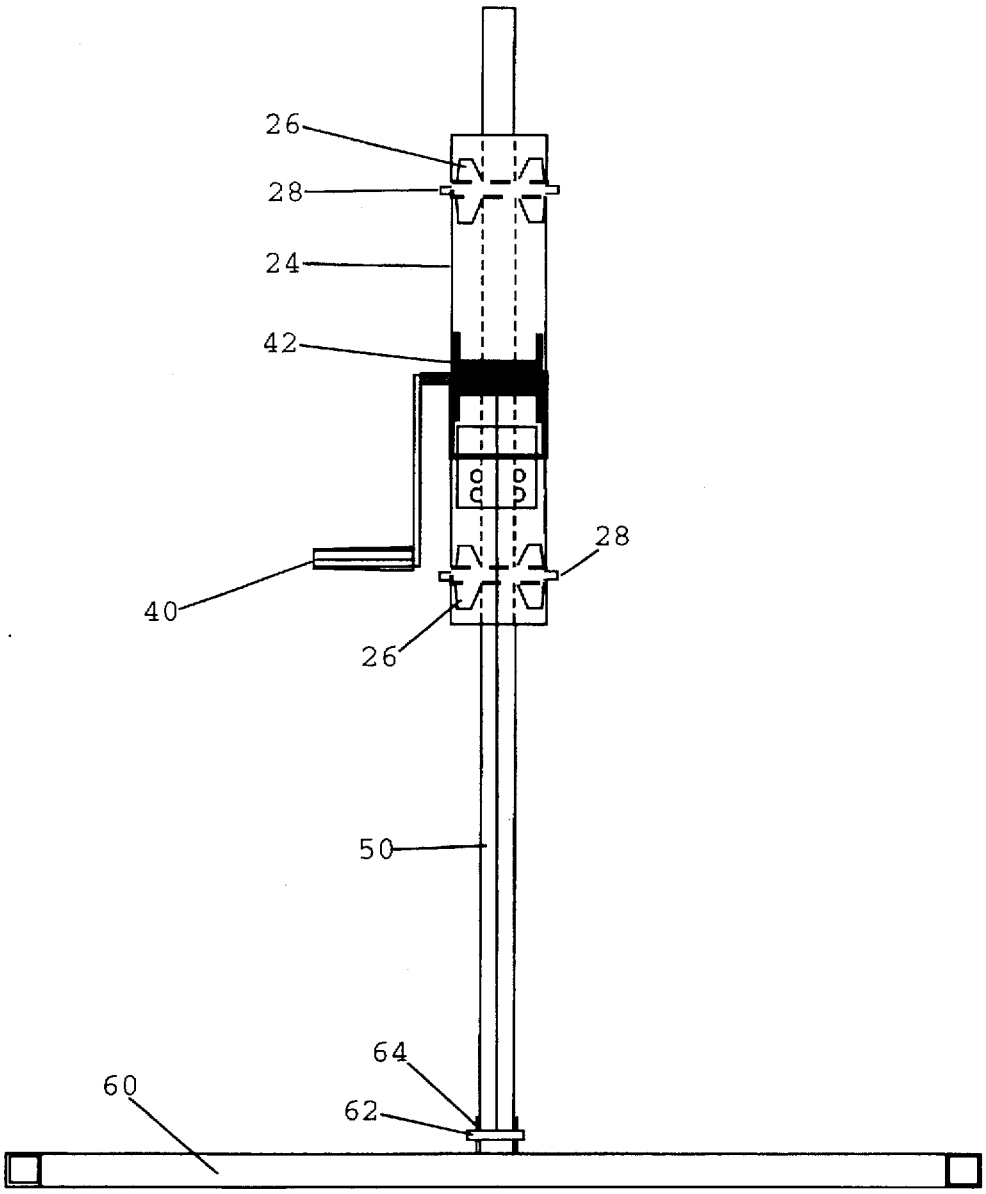
FIG. 4 is a front view of the watercraft lift according to the present invention.

Referring now to the drawings, and particularly to FIG. 1, the watercraft lift according to the present invention is there illustrated. The lift is of the type that is connected to a mooring location such as a dock, pier or piling for moving a watercraft into a body of water for use and out of the body of water for storage. A watercraft such as a Sea-Doo, Jet-Ski or other inboard/outboard boat B is shown schematically positioned on the lift, generally indicated at 10.

The watercraft lift 10 comprises a mounting means 20 in the form of a generally U-shaped bracket (best shown in FIG. 1) or that is adapted to be connected to the piling as will be more fully explained hereinbelow.

An elongate rectangular tubular guide means or guide 24 is connected to the mounting means as shown in FIG. 1. The mounting means 20 and the bracket means 24 both contain openings through which mounting screws 22 are inserted and by which they are fastened to piling P. Four separate roller means 26 are mounted within the tubular guide 24 via suitable means such as by pins 28 inserted therethrough and secured by cotter pins 30.

A winch means or winch 40 is operatively associated with the tubular guide 24 and is connected thereto via suitable means such as by nuts and bolts or welding. The winch 40 may be either a conventional mechanical or electrical winch as is commonly employed in marine applications. Generally the winch 40 includes a spool 42 upon which a wire cable 44 is wound, associated gears (not shown) and a handle 48.

The cable is connected at one end to the winch and at the other end is connected so as to be operative to raise and lower the elongate member upon actuation of the winch. More specically, the cable 44 has one of its ends connected to the winch spool 42 and the other end is connected to a pin 62 located on a bracket 64 located at the bottom of elongate member 50 upon which support bracket 60 is mounted.

An elongate member 50 having an upper end and a lower end is mounted for reciprocating movement within said tubular guide 24 between rollers 26.

A support bracket means or support bracket 60 is connected to the elongate member 50 proximate its lower end for supporting a watercraft resting thereon.

The installation of the watercraft lift 10 is fast and simple. The first step is to attach the mounting means 20 and tubular guide 24 to the piling. The openings in the foregoing are placed in alignment and wood screws or bolts are inserted therein and fastened to the piling. Thereafter, the rollers 26 are placed in position within the tubular guide 24 in alignment with the openings in the tubular guide 24 and pins 28 are inserted therethrough. Cotter pins 30 are then inserted in the far end of the pins 28 to maintain the rollers 26 in position. Next, the elongate member 50 is inserted between the rollers 28 for vertical or reciprocating movement. Lastly, the end of the winch cable is connected to pin 62.

In operation, when it is desired to remove a watercraft from the water for storage, the support bracket 60 is lowered into the water by unwinding cable 44 off of winch spool 42 a sufficient depth so as to be below the deepest portion of the hull of the watercraft to be lifted. The watercraft is then positioned centrally above the support bracket means and handle 46 is rotated in order to wind cable 44 back on to spool 42, thus raising the watercraft up and out of the water. When it is desired to return the watercraft to the water, the foregoing process is performed in reverse.

Figure 5:
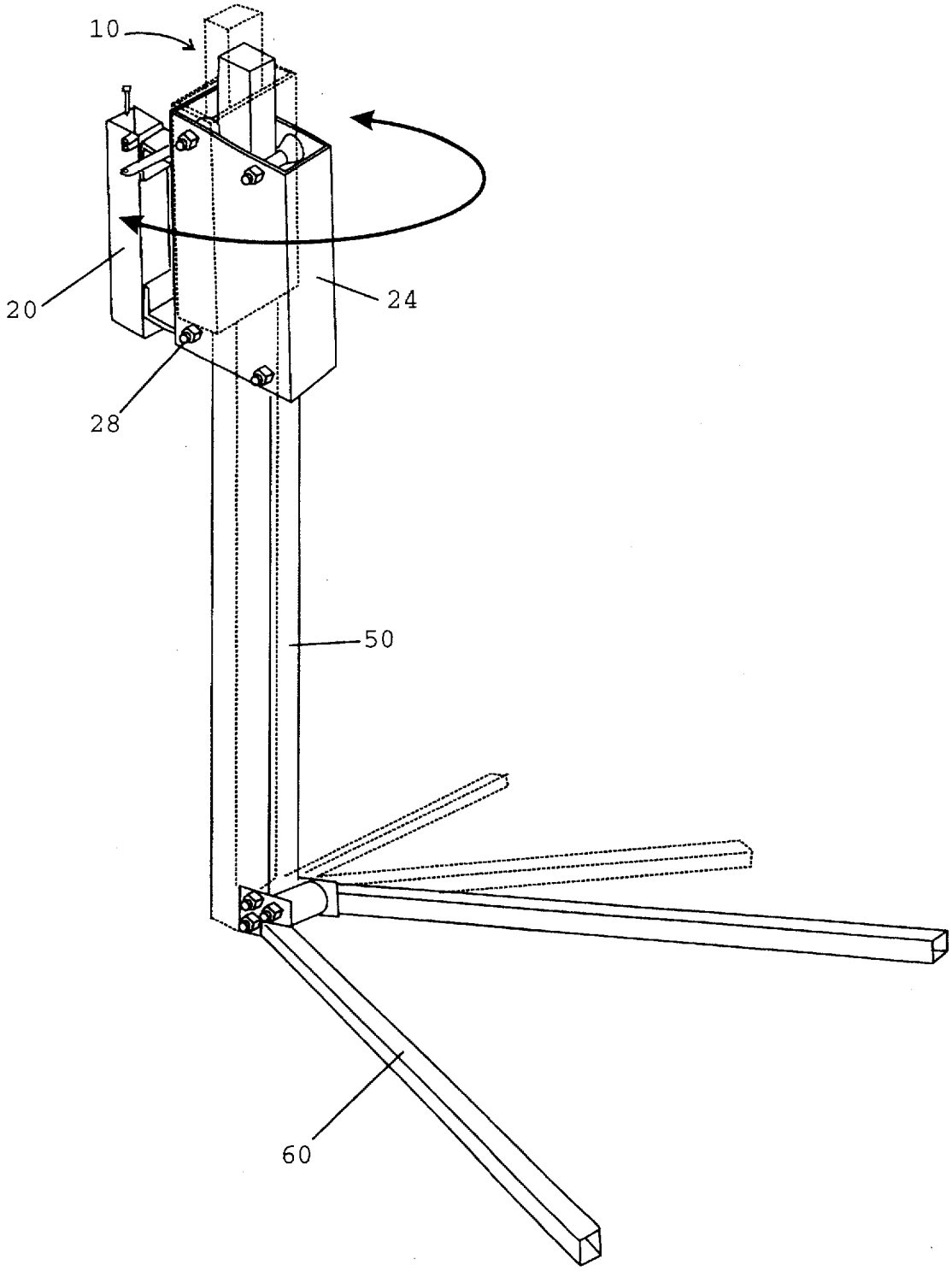
FIG. 5 is a perspective view of a second embodiment of the watercraft lift according to the present invention.
Figure 6:
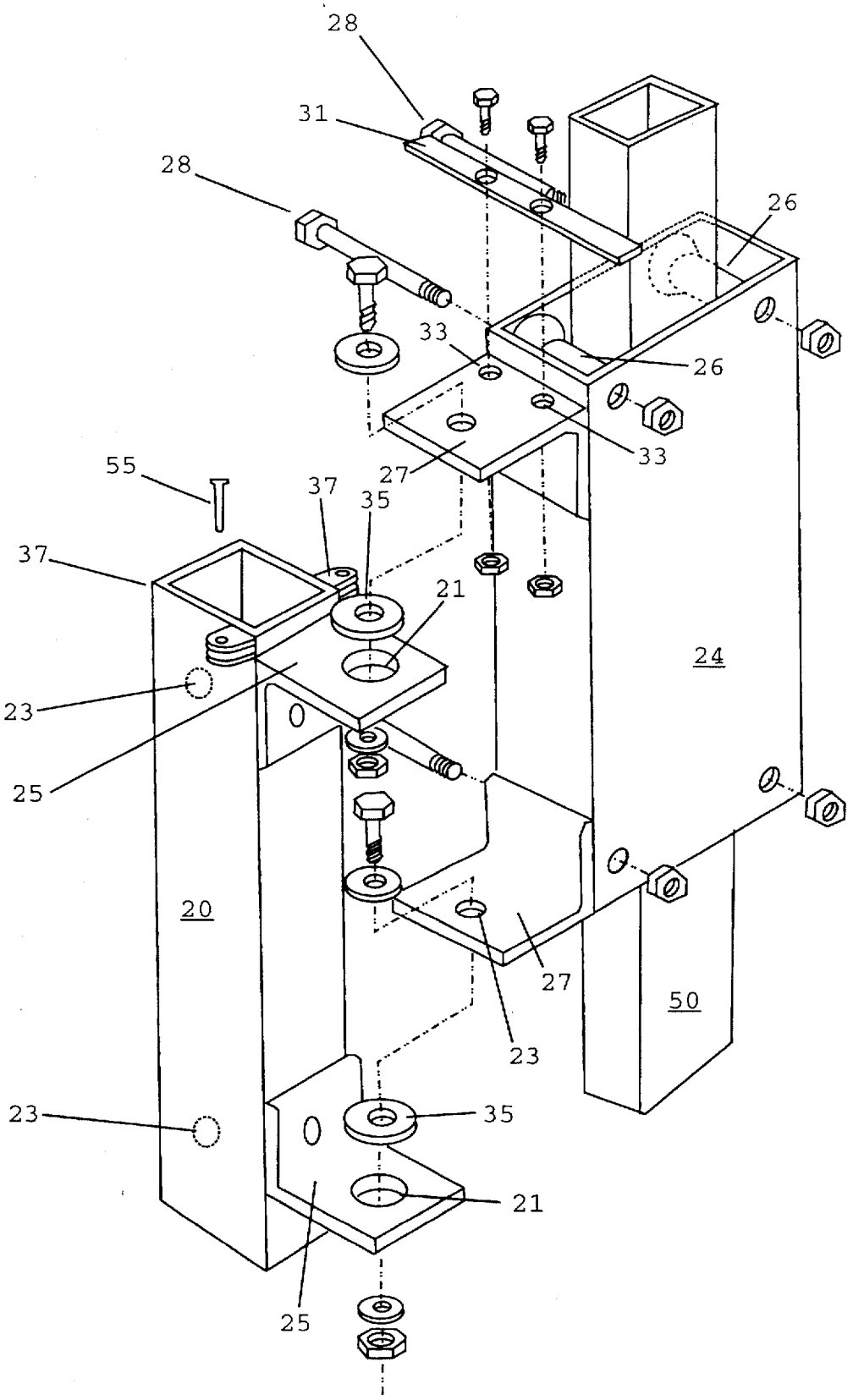
FIG. 6 is an exploded view of the cooperating pivoting assemblies according to the second embodiment of the watercraft lift according to the present invention.
Figure 7:
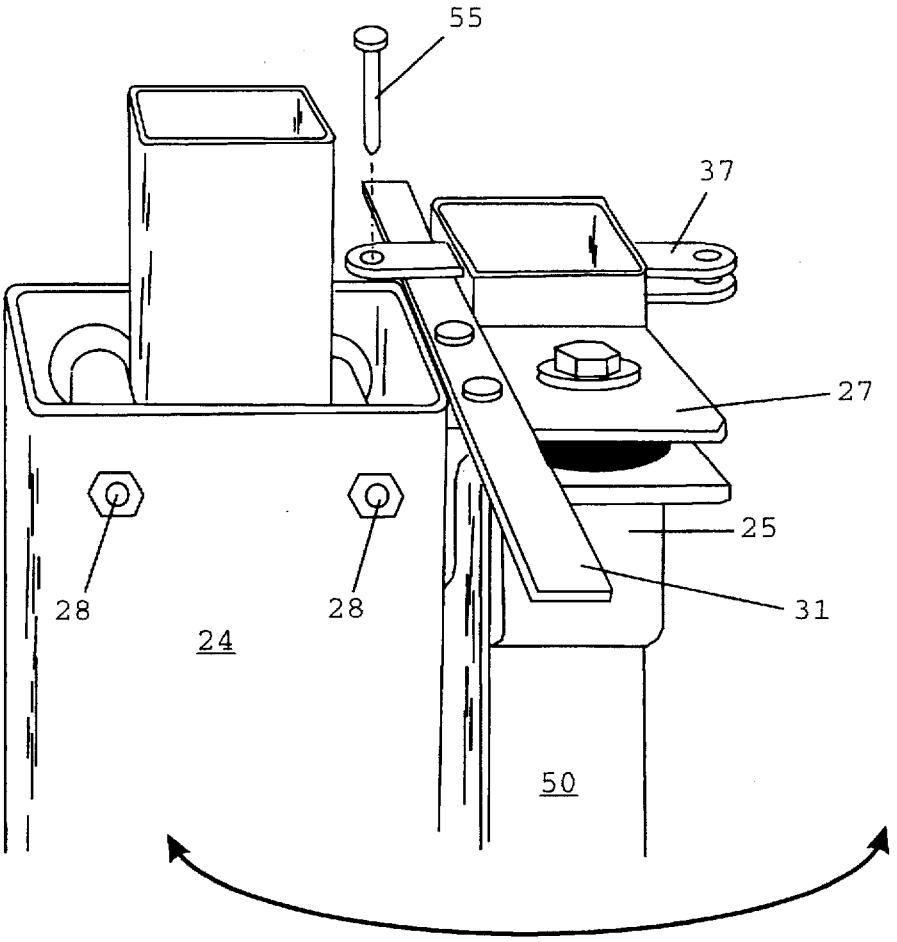
FIG. 7 is a perspective view of the locking mechanism according to the second embodiment of the watercraft lift according to the present invention.

A second embodiment of the invention is disclosed in FIGS. 5–7. In the ensuing description with respect to said second embodiment, the same reference numerals are employed to refer to corresponding or like elements which have been previously discussed.

Referring now specifically to FIGS. 5–7, a mounting means 20 in the form of an elongate, generally square bracket is adapted to be connected to the piling. The mounting means includes a pair of openings 23 through which mounting bolts (not shown) may be inserted to secure the mounting means to the piling. A pair of mounting brackets 29 extend outwardly from the body of the mounting means 20 and are attached by suitable means, such as welding. In addition, the mounting means includes two pairs of oppositely facing spaced arcuate protrusions 37 having an opening therein, as will be more fully explained hereinbelow. Further, another pair of brackets 25 forming one half of a hinge is provided with opening 21.

The guide means or guide 24 in the form of a hollow tubular housing has a plurality of bearing means or roller bearings 26 mounted within the guide means via suitable means such as pins or bolts 28 inserted therethrough and secured with appropriate lock nuts. As employed herein, the bearings 26 are cut from lengths of extruded solid Teflon or rubber rods and are provided with a bore through the center thereof to allow insertion of the mounting bolt to pass therethrough. A pair of spaced mounting brackets 27 extend outwardly from one side of the guide 24 and are attached by suitable means, such as by welding. Each of the aforesaid mounting brackets 27 is provided with an opening 29. In addition, a locking bar 31 is attached to the upper most mounting bracket 27 via a nut and bolt combination (as shown), welding or other suitable means.

As briefly mentioned hereinabove, the mounting means is bolted to the piling or other support means. Thereafter, the mounting means 20 and the guide means are connected together via means of the brackets 25, 27 which together form hinges upon which the guide means 24 pivots. The mounting means and the guide means are hingedly connected such that the guide means pivots between a first position and a second position. As shown, the brackets 27 on the guide means 24 are mounted such that they rest upon brackets 25 with a suitable bearing 35 positioned therebetween. This configuration is preferred so that the mounting means is load bearing.

The winch means or winch 40 is operatively associated with the tubular guide 24 and the support bracket 60 as discussed hereinabove with reference to the embodiment disclosed in FIGS. 1 through 4. In addition, the elongate member 50 is mounted for reciprocating movement within the guide means 24 as previously discussed.

In operation, when it is desired to remove a watercraft from the water for storage, the support bracket 60 is lowered into the water by unwinding cable 44 off of winch spool 42 a sufficient depth so as to permit the watercraft to be floated thereon. The watercraft is then positioned centrally above the support bracket means and handle 46 is rotated in order to wind cable 44 back on to spool 42 (or an electric winch is activated), thus raising the watercraft up and out of the water. The watercraft may then be locked in place in either the aforesaid first position or second position by pivoting the guide means 24 such that the lock means (which comprises the metal protrusions of bar 31 and one of protrusions 37) becomes engaged. Thereafter, locking pin 55 (or conventional key/combination lock) is inserted through the openings in protrusions 37 and the lift is locked in place thereby preventing unauthorized use of the watercraft. The present invention also provides a unique feature in that the watercraft may be removed from the water and placed on the ground, dock or other supporting structure when not in use, and visa vera. After the watercraft is removed from the water and raised, the pivoting guide means allows approximately 180 degree rotation of the entire lift assembly. Thus, the watercraft may be swung from a position overlying the water to a position overlying the support structure, the winch may then be activated to lower the watercraft so that it is placed on the ground or other suitable rest (such as a cradle) and the lift locked in place to prevent unauthorized use. Of course, the entire procedure may be reversed to place the watercraft back into the water.

The present invention, of course may be carried out in other specific ways than those herein set forth without departing from the spirit and essential characteristics of the invention. The present embodiment is therefor, to be considered in all respects as illustrative and not restrictive, and all changes coming within the meaning and range of the appended claims are intended to be embraced therein.

That which is claimed is:

1. A personal watercraft lift to be used in combination with a mooring location for moving a watercraft into a body of water for use and out of a body of water for storage and comprising:

a mounting means for mounting the lift to the mooring location, which mounting means connects above the water's surface;

a guide means connected to said mounting means, which guide means connects above the water's surface and rests above the surface when not in use and further, wherein said guide means comprises a tubular housing having a plurality of roller means positioned for rotation therein;

an elongate member operatively associated with said guide means and being mounted for reciprocating movement, said elongate member having an upper end and a lower end;

a support bracket means connected to said elongate member proximate the lower end thereof and being adapted to support a watercraft resting thereon; and a winch means operatively associated with said guide means for raising and lowering said elongate member;

whereby the watercraft may be placed in and removed from the water.

2. A personal watercraft lift according to claim 1 wherein said mounting means and said guide means are hingedly connected such that the guide means is moveable between a first position and a second position.

3. A personal watercraft lift according to claim 2 wherein said first position overlies the water and the second position overlies the mooring location, whereby the watercraft may be placed in and removed from the water.

4. A personal watercraft lift according to claim 2 further including a lock means for locking the guide means in either the first or second locations.

5. A personal watercraft lift to be used in combination with a mooring location for moving a watercraft into a body of water for use and out of a body of water for storage and comprising:

a mounting means for mounting the lift to the mooring location, which mounting means connects above the water's surface;

a guide means in the form of a hollow tubular housing connected to said mounting means, which guide means connects above the water's surface and rests above the surface when not in use, and further wherein said guide means includes a plurality of rollers mounted within said tubular housing and wherein said mounting means is hingedly connected such that the guide means pivots between a first position and a second position;

an elongate member positioned within said guide means for reciprocating movement therewithin, and being operatively associated with said rollers said elongate member having an upper end and a lower end;

a winch means operatively associated with said guide means for raising and lowering said elongate member;

whereby the watercraft may be placed in and removed from the water.

6. A personal watercraft lift according to claim 5 further including a lock means for locking the guide means in either the first position or the second position.

7. A personal watercraft lift according to claim 5 wherein said winch includes a cable connected at one end to said winch and wherein the other end is connected so as to be operative to raise and lower said elongate member upon actuation of said winch.

8. A personal watercraft lift to be used in combination with a mooring location for moving a watercraft into a body of water for use and out of a body of water for storage and comprising:

a mounting bracket for mounting the lift to the mooring location, said mounting bracket being mounted at a point above the normal high water mark;

a hollow tubular housing hingedly connected to said mounting bracket;

an elongate member positioned within said hollow tubular housing for reciprocating movement therewithin, said elongate member having an upper end and a lower end;

a winch having a cable operatively associated with said hollow tubular housing and being adapted to raise and lower said elongate member; and a support bracket connected to the elongate member proximate the lower end thereof substantially parallel to the surface of the water and being adapted to restingly receive a watercraft thereon;

whereby the watercraft may be placed in and removed from the water.

* * * * *